United States Patent [19]

Koerner

[11] Patent Number: 4,947,610

[45] Date of Patent: Aug. 14, 1990

[54] METHOD AND APPARATUS FOR BUILDING A BRICK WALL

[76] Inventor: Robert Koerner, 1130 E. 3rd St., Coal City, Ill. 60416

[21] Appl. No.: 337,801

[22] Filed: Apr. 13, 1989

[51] Int. Cl.[5] ..... E04C 1/10

[52] U.S. Cl. ..... 52/585; 52/606; 403/298

[58] Field of Search ..... 52/585, 606; 403/292, 403/298; 411/510

[56] References Cited

U.S. PATENT DOCUMENTS 712,839 11/1902 McGowan ..... 403/292

4,454,699 6/1984 Strobl ..... 52/585

*Primary Examiner*—Carl D. Friedman

*Attorney, Agent, or Firm*—Ernest Kettelson

[57] ABSTRACT

A method and apparatus for building a brick wall having tensile strength comprising brick with two spaced apart recesses opening to the top and the bottom surfaces of each brick with one recess centered in the left half of each brick and the other centered in the right half of each brick. The bricks in the row above are offset from the bricks in the row below so the recesses in the left of the brick of the row above, line up with the recesses in the right half of the brick of the row below. The pattern continues with each succeeding row so the finished wall has rows of staggered bricks, with recesses lining up from the top of the wall to the bottom. Coupling fasteners are inserted in the recesses of each brick as each row of bricks is laid, and spacers are placed between each row of bricks to hold the brick apart for filling the spaces in with mortar after the entire wall has been assembled.

22 Claims, 11 Drawing Sheets

METHOD AND APPARATUS FOR BUILDING A BRICK WALL

BACKGROUND OF THE INVENTION

This invention relates to the field of brick wall construction and in particular the method of assembly and the apparatus required to implement the method.

Prior art wall construction designs have aimed at specially constructed building blocks with specially designed connecting rods for tying the blocks to support structures or to other blocks. Connecting designs for tying blocks to other blocks require elaborate conduit passages and key ways and specially designed rods for traversing the entire height of the wall or rods that traverse one block but that require mechanical interlocks to tie the blocks together. Connecting designs for anchoring blocks to support structures also require specially designed passageways and connecting rods to securely anchor the block to the support.

Prior art wall construction has not aimed at utilizing an existing brick design that is inexpensive and extensively used and providing a method of construction for the brick design that allows quick assembly for anyone of average skill in the art yet provides compressive and tensile strength for wall longevity. Further, prior art wall construction has not aimed at reducing the size of standard brick by utilizing a method connecting the bricks together thereby requiring less material and time to construct a brick wall.

One problem with prior art wall construction is that specially designed blocks with specially designed connecting rods are required. These designs cause material costs to increase as well as demanding extra time to assemble. Another problem with prior art wall construction is that the construction design demands high level of skill in the art to assemble the wall.

Examples of prior art devices include those disclosed in the following U.S. Patents:

U.S. Pat. No. 4,694,624 discloses a modular pre-insulate pre-finished building block with structural and insulating elements and fastening rods for the attachment of the blocks to one another and to other wall components. This design doesn't require mortar or cement for securing the wall structure which allows the wall to be disassembled without damage to the blocks or other wall components. One problem with this design is that it is expensive and requires high level of skill in the art to assemble. Another problem with this design is that it was not intended to be used as a curtain or cover wall for the back up or exterior walls of a completed structure.

U.S. Pat. No. 4,583,336 discloses improved connections for preformed concrete construction elements such as girders, beams, columns or plates. The problem with this design is that it doesn't provide for any connections between blocks or bricks in the construction of a wall.

U.S. Pat. No. 4,330,970 discloses improved connections for preformed slab shaped elements that form a roof or floor to a building structure frame. The problem with this design is that is does not provide any information for connections between bricks or blocks to construct a wall.

U.S. Pat. No. 3,780,484 discloses a block design and connecting aligning rods for the construction of a wall. The problem with this design is that specially fabricated blocks are utilized for the construction of the wall which causes an increase in material costs. Further, labor costs will increase because individuals of higher skill in the art will be required. Another problem with the design is that the connecting rods can only be used on blocks constructed as detailed in the patent. The rods cannot be used with any standard brick design used for wall construction.

U.S. Pat. No. 3,315,427 discloses block-like elements and panel-like members substantially identical to each other to build walls, fences, columns, barricades and a large variety of like structures. One problem with this design is that the blocks and fasteners are specially constructed causing the material and labor costs to increase. Further, the connecting fasteners cannot be used on any existing brick designs because of their unique design. Another problem with the design is that the blocks cannot be offset between rows the same as a brick wall due to the hole location in the block.

U.S. Pat. No. 3,295,287 discloses a curtain wall support for tying a backup wall to a curtain wall. This patent does not disclose any connecting fasteners between the blocks. Further, no spacers are disclosed to allow mortar to be inserted between the blocks after the blocks have been assembled.

U.S. Pat. No. 3,176,433 discloses a furnace wall construction utilizing heat resistant bricks stacked on top of each other with a connecting rod running through a hole in the center of each brick to keep the bricks in place. One problem with this design is that the bricks cannot be offset between rows as in the typical brick wall construction. Another problem with this design is that the bricks are not spaced apart and no mortar is utilized as in the typical brick wall.

U.S. Pat. No. 3,165,750 discloses a delay type lens consisting of foamed blocks variable loaded with interlinking inserted rods. The purpose of this device is to focus radio waves with the inserted rods utilized to vary the electrical characteristics of the device. This invention does not relate to wall construction.

U.S. Pat. No. 2,212,184 discloses construction blocks with holes from top to bottom and side to side that align with holes of other blocks. Through these holes steel rods run a specified distance to form a wall a specified height and thickness. One problem with this design is that offsets between rows as in brick walls cannot be formed. Another problem with the design is that the rod design is unique to the block design. The rods cannot be used on any standard brick design. Another problem with this design is that the constructed wall's function is to act as a backup wall or structure support wall rather than a curtain wall as is the function of a brick wall.

U.S. Pat. No. 2,141,397 discloses the reinforced construction of a wall with specially designed blocks with holes running from top to bottom, rods that run through the holes from the bottom block to the top block, and spacers that automatically set each block a specified distance from each block adjacent to it. The problem with this design is that the rods are unique to the block design and cannot be used on any standard brick design. Another problem with this design is that the constructed wall's function is to act as a backup wall or structure support wall rather than a curtain wall as is the function of a brick wall.

U.S. Pat. No. 932,261 discloses a double wall construction assembly used when exceptionally great lateral stresses are experienced. The double wall requires specially designed blocks with holes running from top to bottom at the center and at each end. Piles run from the top block to the bottom block and into the ground through the holes of every block forming the double wall. Tie bars are included that connect piles together that are directly across from each other in the double wall. The problem with this design is that the blocks have to be of special design as does the connecting piles. The piles could not be used with a standard brick utilized in wall construction. Further, the double wall design is to resist strong lateral forces. The conventional brick wall design is not intended to bear the lateral forces in the aforementioned patent. Another problem with this design is that the piles extend into the ground. The typical brick wall is built upon an already existing foundation that would not allow a pile to extend into the ground.

U.S. Pat. No. 872,364 discloses a specially designed cement block with grooves on opposite sides and holes running from the bottom to the top of the block. The grooves allow girders containing holes to run from the front blocks to the back blocks that form the wall.

Shafts then run from the top block in the wall, through the girders, and through the bottom block in the wall. Every block is tied together no matter how high or how thick the wall becomes. One problem with this design is that the connecting system is for a wall at least two blocks thick, while the standard brick wall is only one block thick. Another problem is that the connecting system cannot be used to tie standard brick together because the brick contains no grooves. Further, this patent design is for backup wall structural support wall whereas a design utilizing brick is to construct a curtain wall.

An Italian company known as The Unimorando Consortium, or one of its predecessors or affiliates, has produced and sold what they identify as the Key Brick System, also known as K.B.S., in which specially shaped bricks are made having holes as well as lateral and longitudinal grooves to mate with corresponding grooves in adjoining bricks, which when mated together form channels through which vertical and horizontal re-inforcing steel bars can be received and liquid or "easy flowing" mortar or comparable material then poured. When the mortar hardens and sets, the embedded re-inforcing bars help to hold these specially constructed bricks from falling away from each other during an earthquake. They do not however appear to provide tensile strength to a brick wall that prevents pulling one brick upwardly and away from the adjacent brick below. The Key Brick System does use locating pins inserted in aligned recesses of adjacent bricks to hold them in place until the vertical and horizontal re-inforcing bars are inserted through the respective channels, the mortar poured and hardened, after which the locating pins do not appear to perform any further significant function. The pins are made of plastic and do not have laterally extending ribs that would tend to hold adjacent bricks together when inserted in corresponding aligned recesses. Instead they have longitudinal ribs for the apparent purpose of facilitating insertion into the aligned recesses of the adjacent bricks, which in turn means that withdrawal from the recesses and separation of the bricks would likewise be made easier by use of longitudinally extending ribs.

Another Italian company known as SACMI has manufactured and sold a die base and matrix known as an STM die which can be used to make the specially designed bricks having the holes, grooves and special configurations for use in the Key Brick System of The Unimorando Consortium described above.

SUMMARY OF THE INVENTION

It is an object of the invention to provide a method for building a brick wall in which the brick wall has tensile strength.

It is an object of the invention to provide a method for building a brick wall before applying mortar.

It is an object of the invention to provide a method for building a brick wall that utilizes standard brick or brick smaller in thickness than the standard construction brick.

It is an object of the invention to provide a method for building a brick wall with brick having two spaced apart holes drilled through from the top surface to the bottom surface, one hole being centered in the left half of the brick and the other hole centered in the right half of the brick.

It is an object of the invention to provide a method for building a brick wall with bricks in the row above offset from the bricks in the row below so the holes in the left half of the row above line up with the holes in the right half of the row below. The same with each succeeding row so the finished wall has rows of staggered bricks, with holes lined up from the top of the wall to the bottom.

It is an object of the invention to provide a method for building a brick wall with fastener means to tie upper rows of brick to lower rows of brick before applying mortar.

It is an object of the invention to provide a method for building a brick wall with spacer means to separate upper rows of brick from lower rows of brick before applying mortar.

It is an object of the invention to provide a method to assemble a brick wall then use grouting machine means to pour mortar under pressure in the gaps between spaced apart bricks.

It is an object of the invention to provide a method for building a brick wall comprising brick of standard or reduced thickness having two spaced apart holes drilled through from the top surface to the bottom surface, one hole being centered in the left of the brick and the other hole centered in the right half of the brick, the bricks forming rows that are offset from rows of bricks below so the holes in the left half of the row of bricks above line up with the holes in the right half of the row of bricks below and the same with each succeeding row so the finished wall has rows of staggered bricks with holes lined up from the top of the wall to the bottom, fastener means to tie upper rows of brick to lower rows of brick before applying mortar, spacer means to separate upper rows of brick from lower rows of brick before applying mortar, tie member means to connect a brick wall to a backup wall before applying mortar, grouting machine means to pour mortar under pressure in the gaps between spaced apart bricks :n an already assembled wall.

DESCRIPTION OF PREFERRED EMBODIMENT

Figure 1:
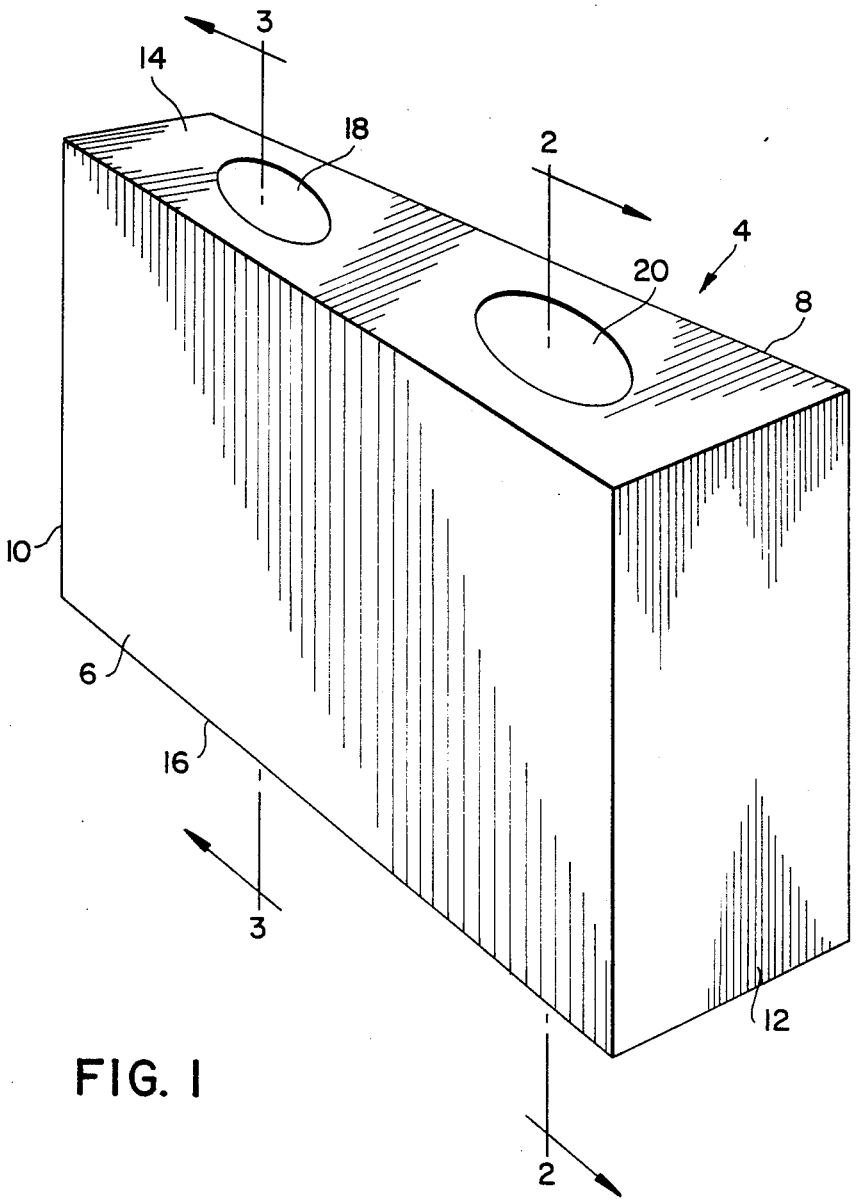
FIG. 1 is an isometric view of a brick with recesses having a circular cross-section to construct a brick wall with tensile strength.
Figure 2:
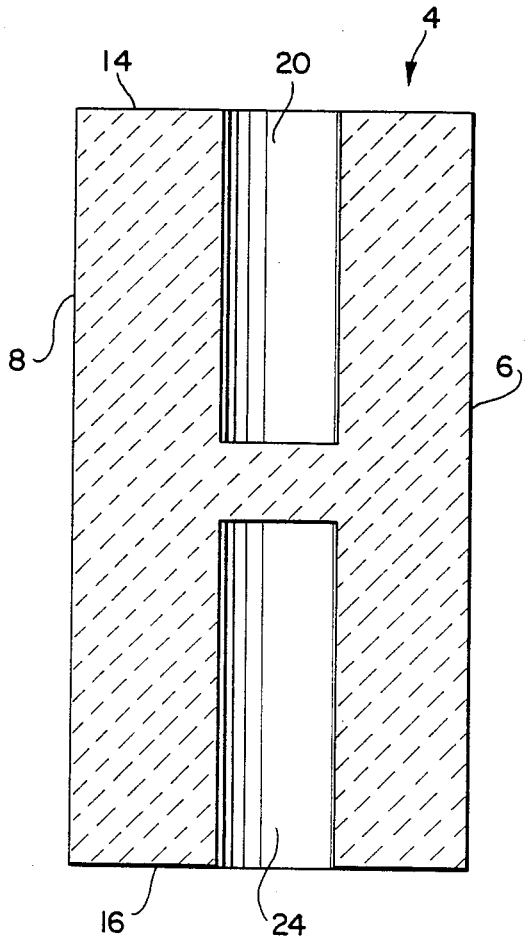
FIG. 2 is an enlarged section view taken on line 2—2 of FIG. 1, showing the recesses in the right half of the brick utilized to construct a brick wall.
Figure 3:
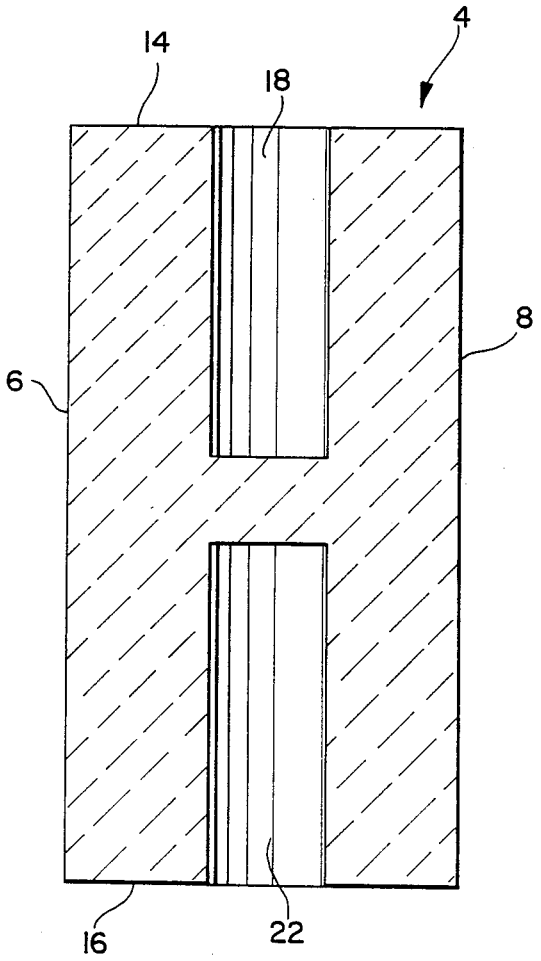
FIG. 3 is an enlarged section view taken on line 3—3 of FIG. 1, showing the recesses in the left half of the brick utilized to construct a brick wall.
Figure 4:
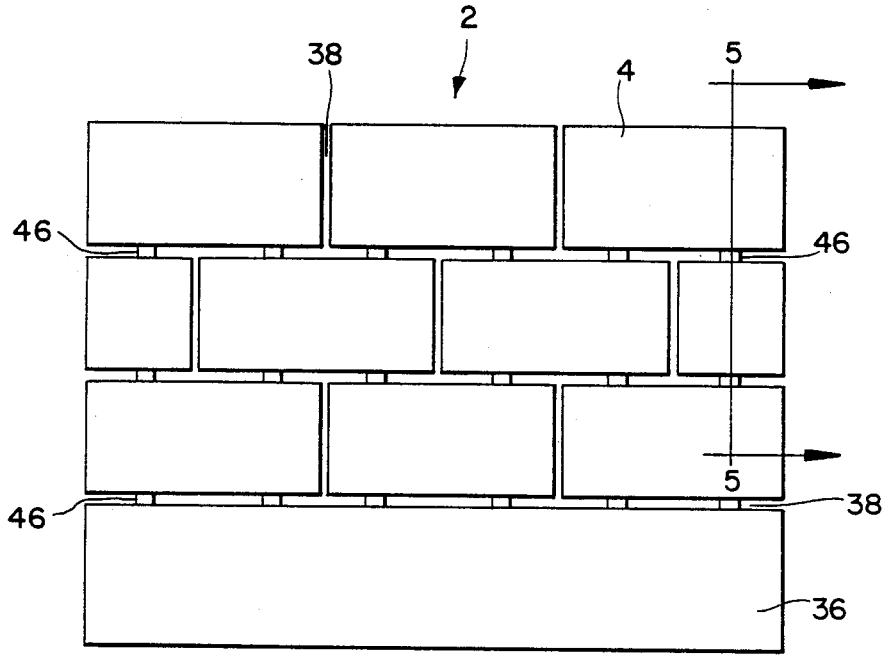
FIG. 4 is a front elevation view of an assembled brick wall showing the brick and brick spacers separating and supporting the rows of brick.
Figure 5:
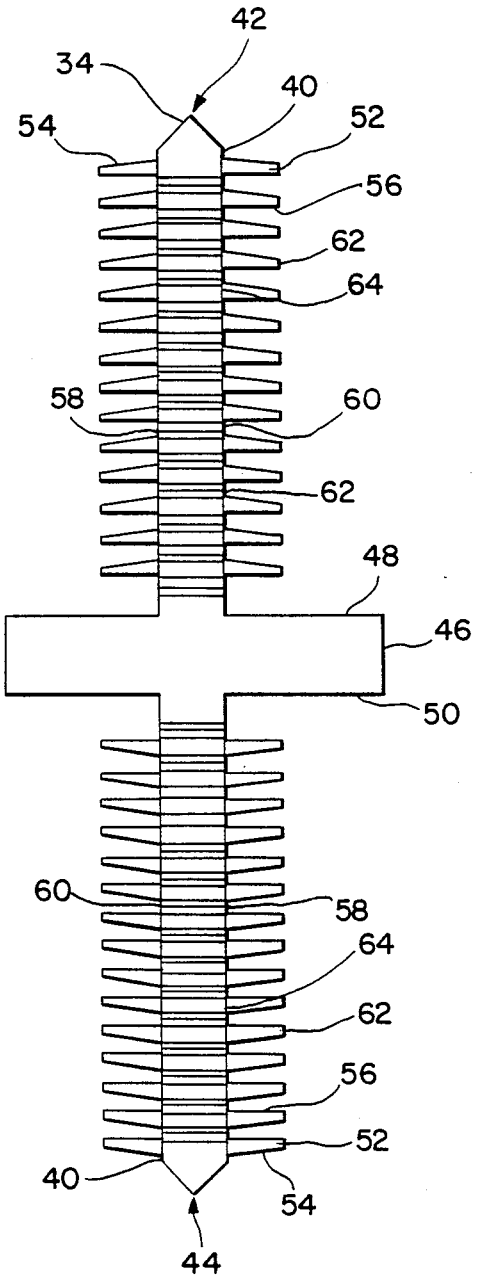
FIG. 5 is a front elevation view of a brick fastener utilized to tie the bricks together to give the assembled brick wall tensile strength.
Figure 6:
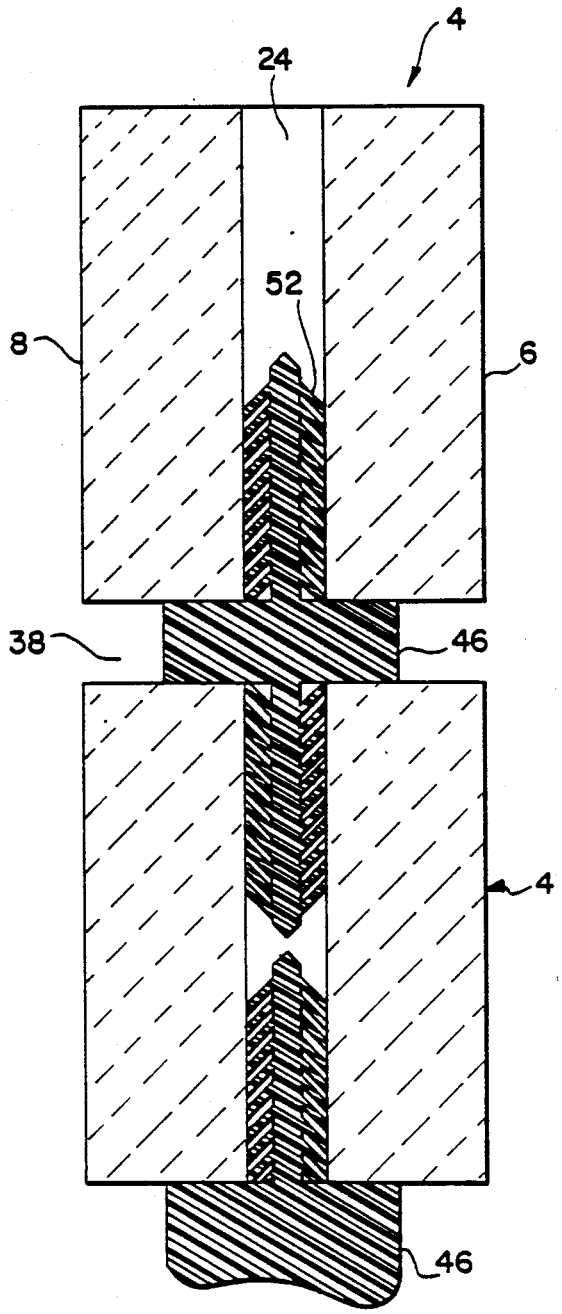
FIG. 6 is an enlarged section view taken on line 6—6 of FIG. 4 showing the bricks tied together by the brick fastener with the ribs of the brick fastener in a flexed position.
Figure 7:
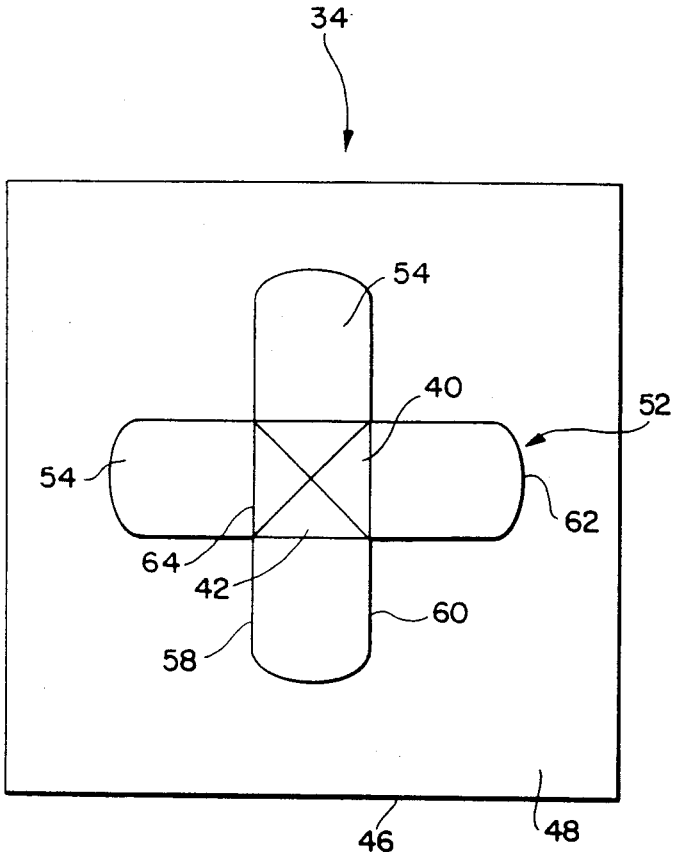
FIG. 7 is an enlarged top plan view of the brick fastener in FIG. 5 showing the brick spacer and the upper end of the shank with the ribs in a non-flexed position.

A brick wall 2 with tensile strength in accordance with the present invention includes bricks 4 comprised of a front wall 6, back wall 8, first end wall 10, second end wall 12, upper wall 14 and lower wall 16 with recess 18 located in the left half of the brick, opening to the upper wall 14 of brick 4, recess 20 located in the right half of the brick, opening to the upper wall 14 of brick 4, recess 22 located in the left half of the brick, opening to the lower wall 16 of brick 4 and recess 24 located in the right half of the brick, opening to the lower surface 16 of brick 4, with all said recesses receiving brick fastener members 34 to couple the bricks 4 together.

The front wall 6 and back wall 8 of brick 4 are comparable in dimensions to a standard brick, which has a length of eight inches and a height of two and one-fourth inches. The first end wall 10, second end wall 12, upper wall 14 and lower wall 16 of brick 4 in accordance with this invention have only half the surface area of a standard brick. The spaced apart distance between the front wall 6 and back wall 8, which is three and three-fourths inches for a standard brick, has been cut in half for the bricks 4 in accordance with this invention that are used to construct a brick wall 2 which has tensile strength when coupled together with fastener members 34 received in the apertures of adjacent bricks 4 to construct such brick wall 2.

The purpose for the magnitude of the dimension from the front surface to the back surface of conventional prior art bricks is to provide adequate upper and lower surface area to insure stability when constructing a brick wall by keeping the brick wall's center of gravity within the perimeter of the brick's upper and lower surfaces. A brick wall constructed of conventional brick will require mortar to be spread over each row of bricks before the next row can be set in place. Further, mortar will have to be placed between adjacent bricks in the same row as the row is assembled.

A brick wall 2 with tensile strength in accordance with the present invention utilizes bricks 4 with a distance between the front wall 6 and back wall 8 of one-half that of a standard or conventional brick. This reduction is possible because brick fasteners 34 are utilized to couple the brick 4 together as the brick wall 2 is assembled. Further, mortar is not required until after the brick wall 2 has been completely assembled due to the coupling action of the brick fasteners 34. Upon complete assembly of the brick wall 2, mortar is then applied under pressure to the brick wall 2 to give it compressive strength and to make it a solid imperforate wall.

The brick 4 utilized to construct a brick wall 2 with tensile strength in accordance with this invention weighs only one-half as much as a standard or conventional brick. This is due to the reduced lateral dimension between the front surface 6 and back surface 8 of the brick 4. The reduced weight will lead to a reduction in labor costs to construct a brick wall 2. Further, the reduced weight will require less support from the footing 28 upon which a brick wall 2 is constructed, as well as having other advantages.

The bricks 4 utilized to construct a brick wall 2 with tensile strength in accordance with this invention have a first end wall 10 and a second end wall 12 are equal to one-half that of a standard brick. This is due to the reduced lateral dimension between the front wall 6 and back wall 8 of the brick 4. The reduced area will require less mortar to be inserted in the gaps 30 between the first end wall 10 of brick 4 and the second end wall 12 of an adjacent brick 4 in the same row. This benefit will reduce the weight of the brick wall 2 which leads to reduced labor and material cost.

The bricks 4 utilized to construct a brick wall 2 with tensile strength in accordance with this invention have an upper wall 14 and a lower wall 16 area equal to one-half that of a standard brick. This is due to the reduced lateral dimension between the front wall 6 and the back wall 8 of the brick 4. This reduced area will also require less mortar to be inserted in the gaps 30 between the upper wall 14 of a brick 4 and the lower wall 16 of an adjacent brick 4 in the row above. This will also reduce the weight of the brick wall 2 which leads to reduce labor and material costs.

The bricks 4 utilized to construct a brick wall 2 with tensile strength in accordance with this invention are fabricated from the same clay type material as a standard brick. However, other materials could be utilized so long as those materials maintained the structural integrity of the brick 4 after the four recesses 18, 20, 22, 24 are formed in the brick 4.

The recesses 18, 20 opening to the upper wall 14 of brick 4 and the recesses 22, 24 opening to the lower wall 16 of brick 4 are cylindrical. The diameters of the recess 18, 20, 22, 24 are equal and measure approximately three-eights of an inch. The diameters could vary depending on the diameter of the fasteners 26 to be inserted into the recesses 18, 20, 22, 24.

The recesses 18, 20, 22, 24 may extend entirely through the brick 4 from its upper wall 14 to its lower wall 16, and can be formed by the extrusion process when the bricks are being made.

Recess 18 is centered in the left half of the brick 4 and opens to the upper wall 14. Recess 20 is centered in the right half of brick 4 and also opens to the upper wall 14. Recess 22 is centered in the left half of brick 4 and opens to the lower wall 16. Recess 24 is centered in the right half of brick 4 and also opens to the lower wall 16.

The recess 18, 20, 22, 24 need not be centered in their respective half of the surface to which they open to construct a brick wall 2, but the recesses must not be so close to the perimeter of their respective surface that the structure of the brick 4 is weakened. The recesses can be formed by a drilling process or extruded through the entire brick. Further, in certain modifications and within the scope of the invention only one recess could be formed in the brick, opening to the upper wall 14 of brick 4, and one opening to the lower wall 16. Recesses can also be provided which open to the front wall 6 of brick 4, the back wall 8 of brick 4, the first end wall 10 of brick 4 and the second end wall 12 of brick 4 when extra tensile strength is required to construct a brick wall 2. Recesses in the front wall 6 of brick 4 and back wall 8 of brick 4 would be utilized, for example when constructing a brick wall 2 more than one brick thick.

The brick fastener members 34 include a shank 40 approximately two inches in length and square in cross-section when viewing the shank 40 from either end 42 and 44 with each side of the square approximately one-eighth inch in lateral dimension. The shank 40 has an upper tapered end 42 and a lower tapered end 44 for easy insertion of the brick fastener members 34 into any aperture of the brick 4. A brick spacer 46 is integrally formed with the shank 40 at the midsection of the shank 40 in one modification of the fastener members 34. The brick spacer 46 has an upper surface 48 and a lower surface 50 spaced apart a distance equal to the dimension of the desired gap 38 between the bricks 4 of a brick wall 2. A plurality of arcuately shaped ribs 52 are integrally formed with the shank 40 and extend outwardly therefrom in a spaced apart relationship from the upper tapered end 42 of the shank 40 to the upper surface 48 of the brick spacer 46 and from the lower surface 50 of brick spacer 46 to the lower tapered end 44 of the shank 40.

The peripheral configuration of brick spacer 46 is square when viewing the brick fastener 34 from either end 42 and 44 with each side of the square approximately one inch in length, but it may have other peripheral configurations. The upper surface 48 of brick spacer 46 supports the lower surface 16 of a brick 4 and the lower surface 50 of brick spacer 46 is supported by the upper surface 14 of a brick 4, with the distance between the two surfaces being the dimensions of gap 38 for mortar in the brick wall 2. The upper surface 48 and lower surface 50 of brick spacer 46 are shaped substantially square when viewing the brick fastener 34 from either end 42 and 44. However, the surfaces 48 and 50 could be circular so long as the surface areas are large enough to form a stable support for the brick 4 that set upon the brick spacer 46. The lateral cross-section of the spacers 46 is sufficiently greater than the corresponding cross-section of the recesses 18, 20, 22 and 24 respectively, to prevent the spacers from being drawn into the recesses. The lateral cross-section of the spacers must be small enough to stay within the perimeter of the upper wall 14 and lower wall 16 of brick 4.

The spacers 46 need not be integrally joined to the shank 32, but can be separately affixed to the mid-point area of the shank of the fasteners and held in place by set screws or other conventional means.

The arcuately shaped ribs 52 are integrally joined to the shank 40 and extend outwardly from the shank 40. The outwardly extending ribs 52 include an endwardly facing surface 54 which is curved and an opposite inwardly facing surface 56 which is flat. Each rib 52 is thin enough to permit flexing in the directions toward and away from its endwardly facing and inwardly facing surfaces, even though made of relatively rigid material. The ribs 52 also include a first side edge 58 and second side edge 60 spaced apart a distance of about one-eighth inch and an outer gripping end 62 facing away from the shank 40 plus an inner connected end 64 integrally connected to the shank 40. The outer gripping end 62 of the ribs 52 extend outwardly from the shank 40 a distance of about one-eighth of an inch.

The flat inwardly facing surfaces 56 of ribs 52 are spaced apart in planes which are substantially parallel to the upper surface 48 and lower surface 50 of spacer 46 and extend perpendicular to the side of the shank 40 to which each rib 52 is integrally joined.

The first side edge 58 and second side edge 60 or rib 52 are in planes perpendicular to upper surface 48 and lower surface 50 of spacer 46 and perpendicular to the side of the shank 40 to which the rib 52 is joined.

The outer gripping end 62 of rib 52 is shaped to make maximum contact with the recess walls of the brick 4. The outer gripping end 62 opposite from the inner connected end 64 tapers toward a relatively thin cross-section or point at its outer edge for better embedding into and gripping of the brick recess walls when inserted therein. This is due to the curved endwardly facing surface 54 curving toward the flat spacer facing surface 56 from the inner connected end 64 to the outer gripping end 62 of rib 52. The curvature of the curved endwardly direction of insertion of the brick fastener 34. The brick fastener 34 is inserted into two adjacent bricks 4 and must therefore have two opposite directions of insertion. The curvature of curved endwardly facing surface 54 of the ribs 52 on opposite sides of the brick spacer 46 will also be in opposite directions.

The shank 40 is square in cross-section when viewing from either end 42 and 44. Each side of the shank 40 has a plurality of ribs spaced apart along the length of the shank 40. The distance between the curved endwardly facing surface 54 of a rib 52 and the flat inwardly facing surface 56 of an adjacent rib 52 is approximately one-eighth inch.

The ribs 52 on opposite sides of the 40 are in the same plane. The ribs 52 on adjacent sides of the shank 40 are in parallel planes, but the planes are staggered approximately one-eighth of an inch.

The lateral distance between the outer gripping ends 62 of ribs 52 on opposite sides of the shank 40 is slightly greater than the diameter of the recesses 18, 20, 22, 24 formed in the bricks 4. Such relative dimensions will require force to be applied to the brick fasteners 34 when inserting them into the recesses 18, 20, 22, 24 of the brick 4. The amount of force required when inserting the brick fasteners 34 will be lessened because of the curvature of the ribs 52, curved endwardly facing surface 54 curving arcuately away from the direction of insertion. The ribs 52 flex slightly in the direction opposite from the direction of insertion as the fasteners 34 are inserted in the recesses to become positioned and extend at a slightly acute angle relative to the shank 40 when the ribs 52 are received in the recesses of the bricks 4. At such time, the acute angles of the ribs 52 relative to the shank 40 face toward the direction of withdrawal. The ribs 52 are at such time positioned and extend at a slightly obtuse angle relative to the side wall of the recesses facing toward the direction of withdrawal, their outer gripping ends 62 being poised to dig into the side wall of the recesses when an attempt is made to pull the fastener members 34 from the recesses.

After inserting the brick fastener 34 in the brick recess until the brick spacer 46 touches the brick 4, trying to withdraw the brick fastener 34 is very difficult. The flexed angle of the ribs 52 creates a "fish-hook" effect when pulling on the protruding portion of the fastener 34 to remove it. When pulling the fastener 34, the outer gripping ends 62 of the ribs 52 dig into the surface of the walls of the recesses 18, 20, 22, 24 forcing the outer gripping ends 62 of the ribs 52 to try to flex in the direction opposite the direction of pull and outward from the shank 40. This motion forces the outer gripping ends 62 to try to move outwardly as well as to dig into the wall of the recesses even harder.

The distance from the curved endwardly facing surface 54 to the flat inwardly facing surface 56 of the rib 52 may vary from the dimension detailed previously. The critical feature that must be maintained regardless of the dimensions specified is the "fish-hook" effect between the brick fastener 34 and the recess walls which gives the brick wall 2 tensile strength and enables the construction of the brick wall 2 without mortar and with bricks 4 of reduced size.

The brick fasteners 34 may be made from plastic such as vinyl, nylon and the like, but other materials could be utilized so long as the shanks are rigid and ribs 52 are capable of flexing a slight distance and the brick spacer 46 is capable of supporting the brick wall 2 without compressing and thereby decreasing the desired dimension of gap 38 between the bricks 4 of the brick wall 2.

Figure 8:
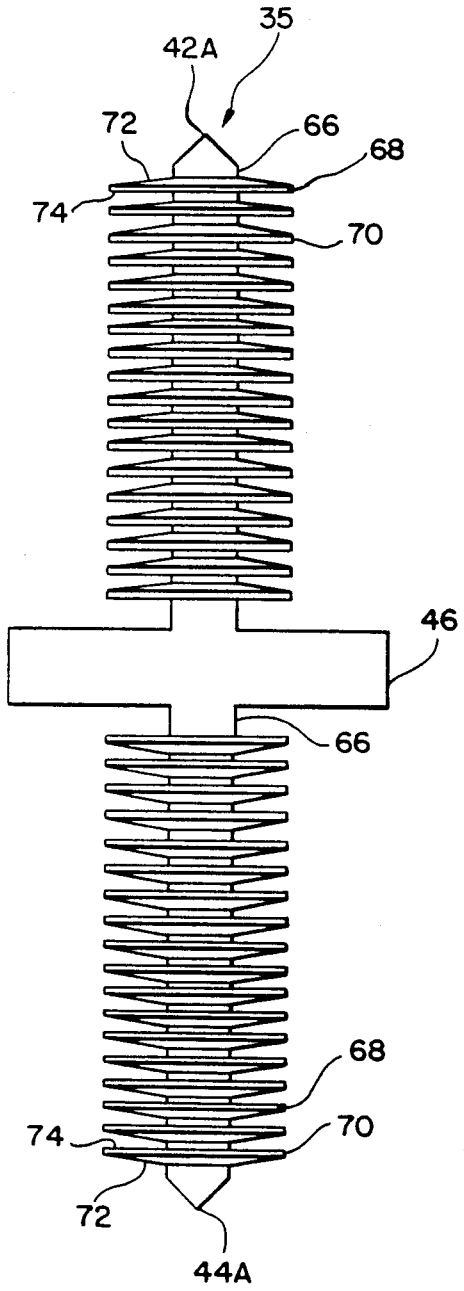
FIG. 8 is a front elevation view of a modified brick fastener showing annular ribs to tie the bricks together.
Figure 9:
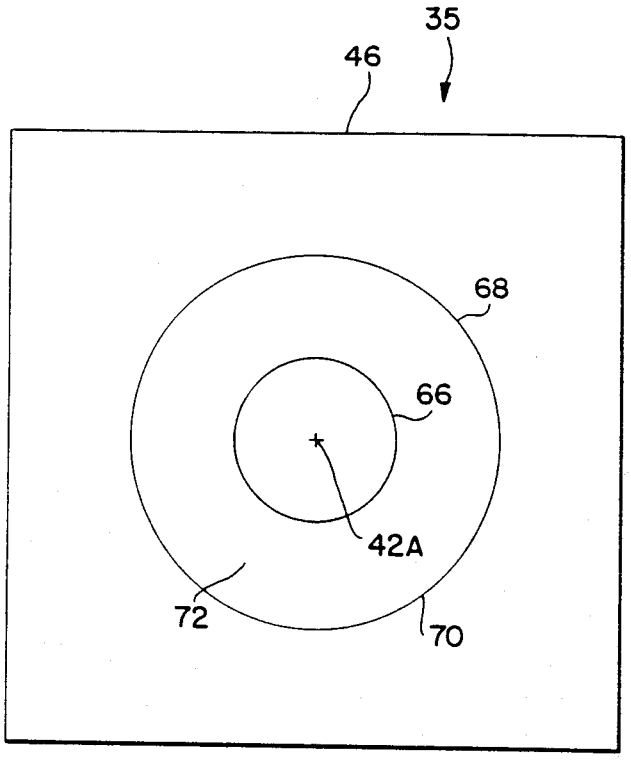
FIG. 9 is an enlarged top plan view of the brick fastener in FIG. 8 showing the brick spacer and the upper end of the shank with annular ribs in a non-flexed position.

A modified brick fastener 35 can have a cylindrical shank 66 with a cross-section that is circular when viewing the fastener 35 from **42*a* as shown in FIG. 9. Also, instead of the aforementioned ribs 52 that extend outward from each side of the shank 40, the modification shown in FIGS. 8 and 9 has annular ribs 68 which provide a stronger gripping contact surface 70 with more surface area to make more contact with the recess walls than the aforementioned ribs 52. The endwardly facing annular surface 72 of the annular ribs 68 are curved away from the direction of insertion. The inwardly facing annular surface 74 of the modified fastener 35 is flat. The distance between the endwardly facing surface 72 and the inwardly facing surface 74 is substantially the same as with the aforementioned ribs 52 to enable them to flex slightly under pressure. The annular rib 68 of the modified fastener 35 wraps completely around the cylindrical shank 66**.

The brick wall 2 is assembled upon a footing 36. Before the first row of bricks are laid, brick fasteners 34 are inserted into the footing 36. This is accomplished by inserting the brick fastener 34 into the wet concrete that forms the footing 36 then allowing the concrete to harden around the brick fastener 34, or by allowing the concrete to harden, then drilling a recess to a depth and diameter equal to the recesses in the bricks 4, then inserting the brick fastener 34 into the recess **34*a* drilled in the concrete footing 36. Also, the distance between the fasteners 34 is set so that a gap 38 is formed between the first end 10 of brick 4 and the second end 12 of an adjacent brick 4**.

Bricks 4 are then placed upon the spacers 46 with the fasteners 34 being inserted into the recesses 22 and 24 opening to the lower wall 16 of brick 4. After the first row of bricks 4 has been set in place, brick fasteners 34 are inserted in the recesses 18 and 20 which open to the upper wall 14 of brick 4.

A second row of bricks 4 is then placed upon the first row with the spacers 46 separating the two rows and the upper end 42 of brick fasteners 34 inserted into the recesses 22 and 24 which open to the lower surface 16 of the brick 4 in the second row. The second row of bricks can be staggered from the first row, or the bricks 4 of the second row can be directly over corresponding bricks 4 of the first row.

The top row of bricks 4 once set in place will require no fasteners 34 which open to the upper surface 14 of the bricks 4. At this juncture, the brick wall 2 has been assembled with the only remaining task being the insertion of mortar under pressure into the gaps 38 between the bricks 4.

Figure 10:
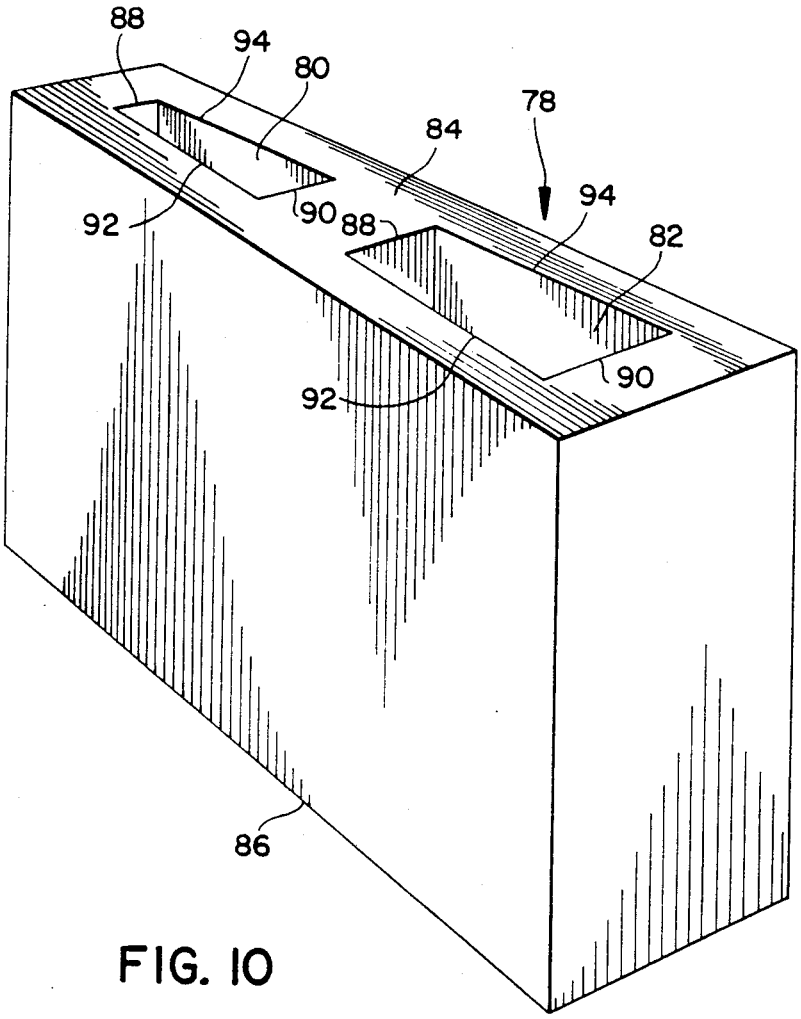
FIG. 10 is an isometric view of a modified brick in accordance with this invention having rectangular apertures utilized to construct a brick wall with tensile strength.
Figure 11:
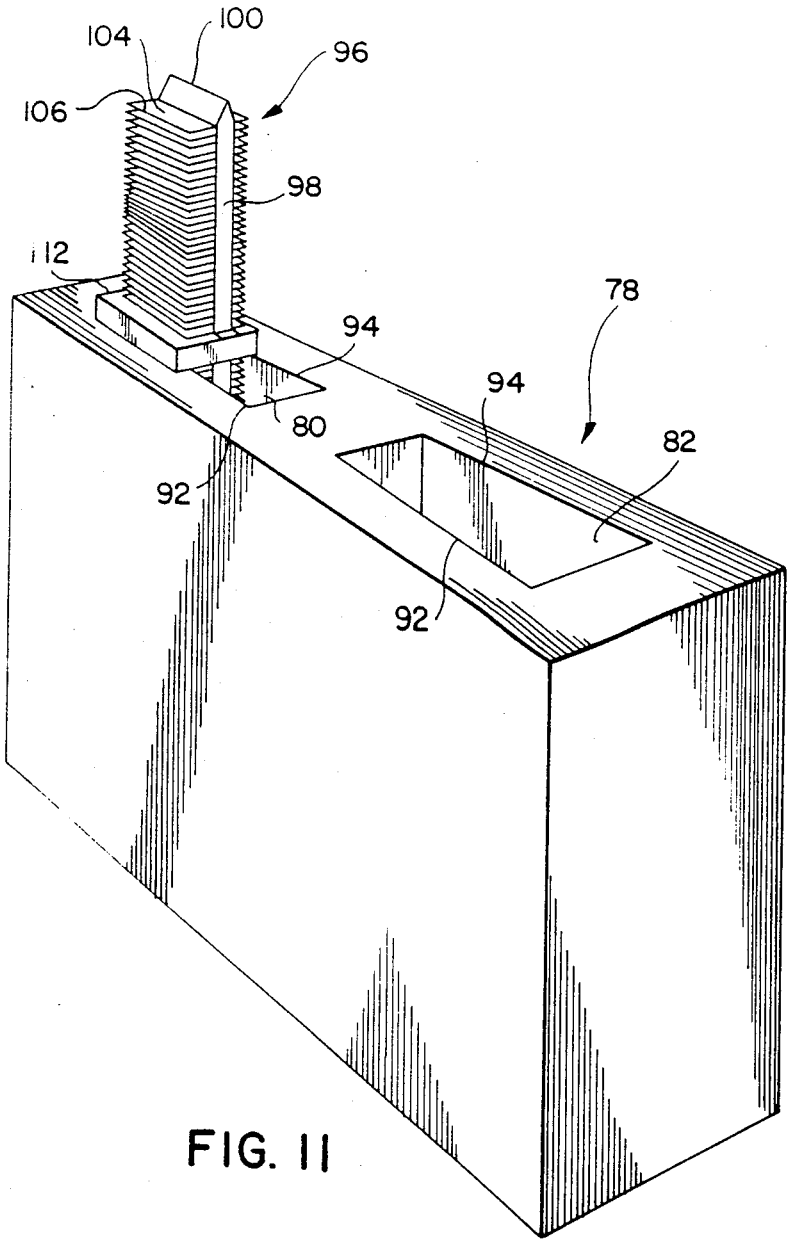
FIG. 11 is an isometric view of the modified brick shown in FIG. 10 having a modified rectangular shaped fastener inserted in one of the apertures.
Figure 12:
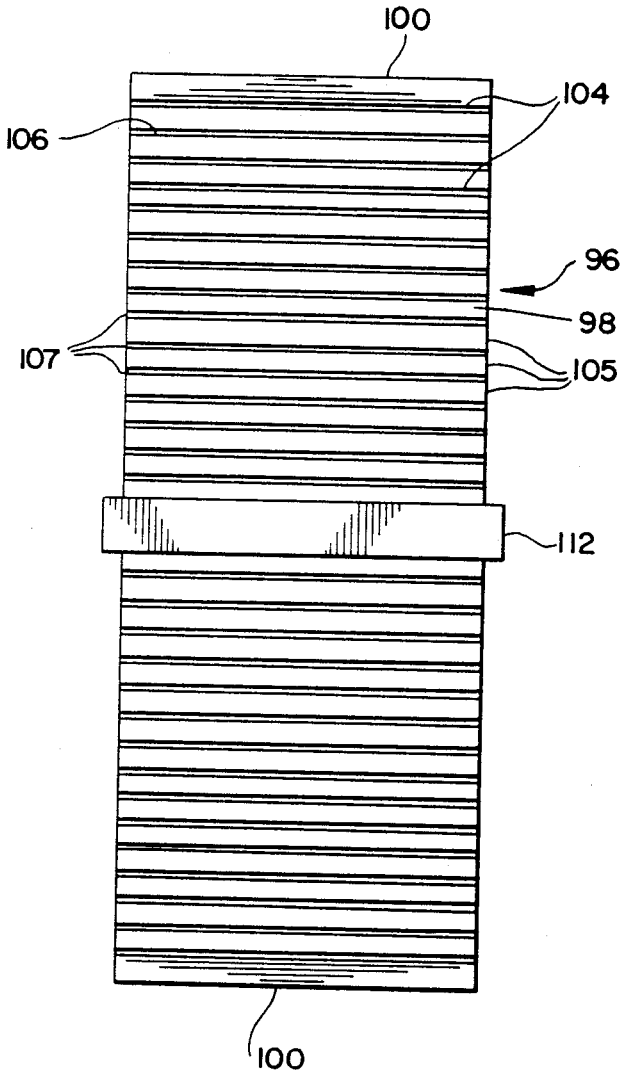
FIG. 12 is a front elevation view of the modified brick fastener shown in FIG. 11.
Figure 13:
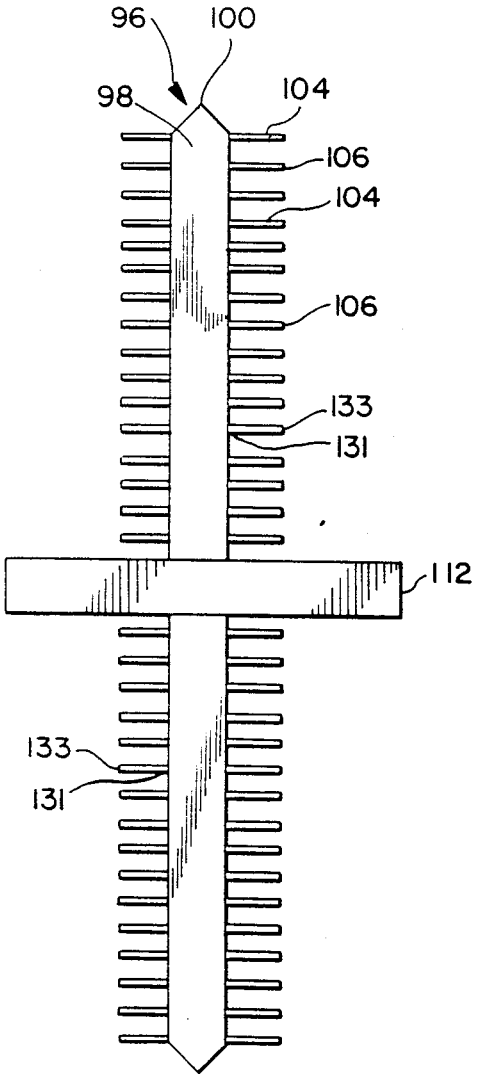
FIG. 13 is a side elevation view of the modified brick fastener in FIG. 12 showing the brick spacer and shank with rectangular ribs in a non-flexed position.
Figure 14:
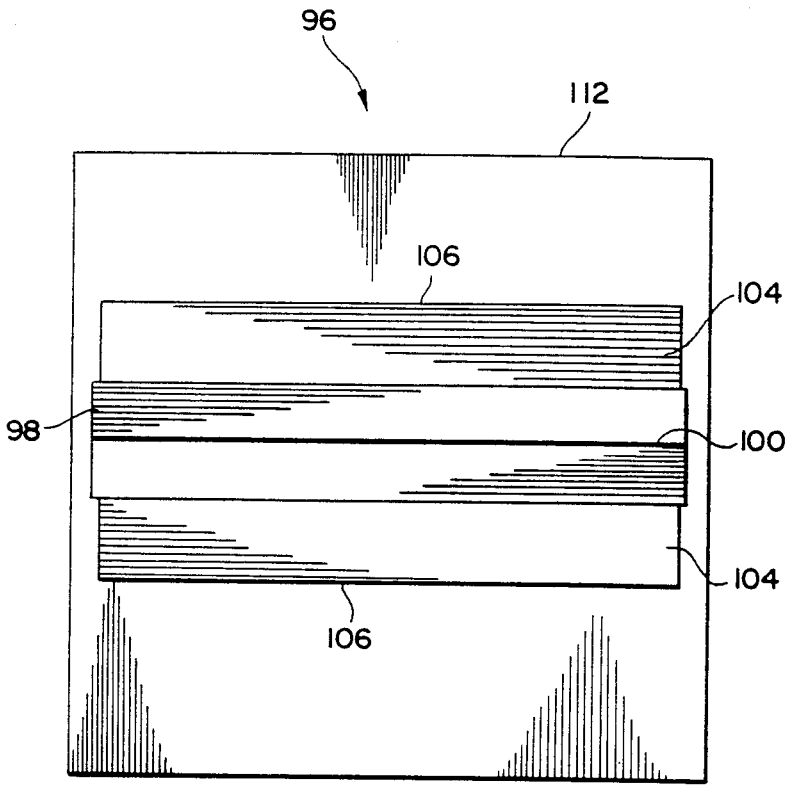
FIG. 14 is an enlarged top plan view of the modified brick fastener shown in FIG. 12 showing the brick spacer and shank with rectangular ribs in a non-flexed position.

A modified brick 78 shown in FIGS. 10 and 11 has two rectangular recesses 80 and 82 formed by an extrusion process with the recesses traversing the brick 78 from the upper wall 84 to the lower wall 86 as shown in FIG. 10. One recess 80 is centered in the left half of the brick 78 and the other recess 82 is centered in the right half. The recesses 80 and 82 are equal in cross-section when viewing brick 78 from either the upper wall 84 or the lower wall 86. The recesses 80 and 82 have a first short side wall 88 and an opposite second short side wall 90 equal in length, and a first long side wall 92 and an opposite second long side wall 94 equal in length, with the length of the long sides approximately twice the length of the short sides.

A modified brick fastener 96 shown in FIGS. 11–14 has a rectangular shank 98 with a rectangular cross-section extending in each opposite direction from integrally formed spacer 112 and terminating at opposite outer ends 100. Instead of the aforementioned ribs 52 that extend outward from each side of the shank 40, the modification shown in FIGS. 11–14 has rectangular ribs 104 extending outward from two sides of the shank 98 to make contact with the long sides 92 and 94 of the aperture walls which provide a stronger gripping contact surface 106 with more surface area to make more contact with the aperture walls of the modified brick 78. The length of modified brick fastener 96 from one end 105 to opposite end 107 of rectangular ribs 104 is less than the corresponding dimension of the long sides 92 and 94 of apertures 80 and 82 of the modified brick 78. The shorter longitudinal length of the fastener 96 permits sliding movement of the fasteners 96 within recesses 80 and 82 to adjust alignment of the bricks 78 and spacing therebetween as the brick wall 2 is assembled.

The ribs 104 of brick fastener 96 are positioned in planes parallel to the brick spacer 112 and perpendicular to the longitudinal axis of the shank 98. Also, the ribs 104 are positioned on opposite sides of the shank 98 with both ribs 104 in the same plane.

Figure 15:
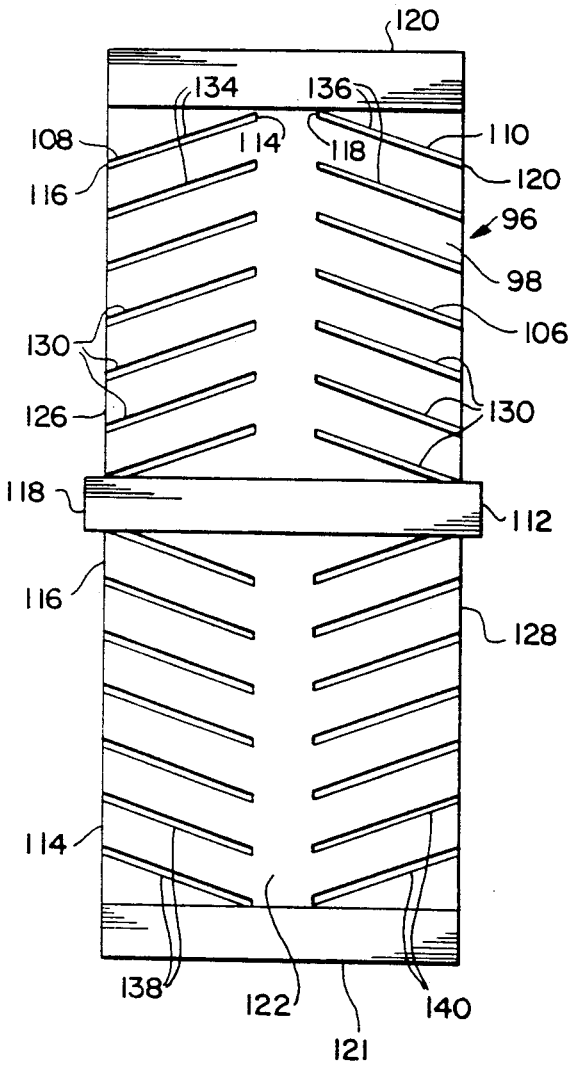
FIG. 15 is an elevation view of another modified brick fastener in accordance with this invention.
Figure 16:
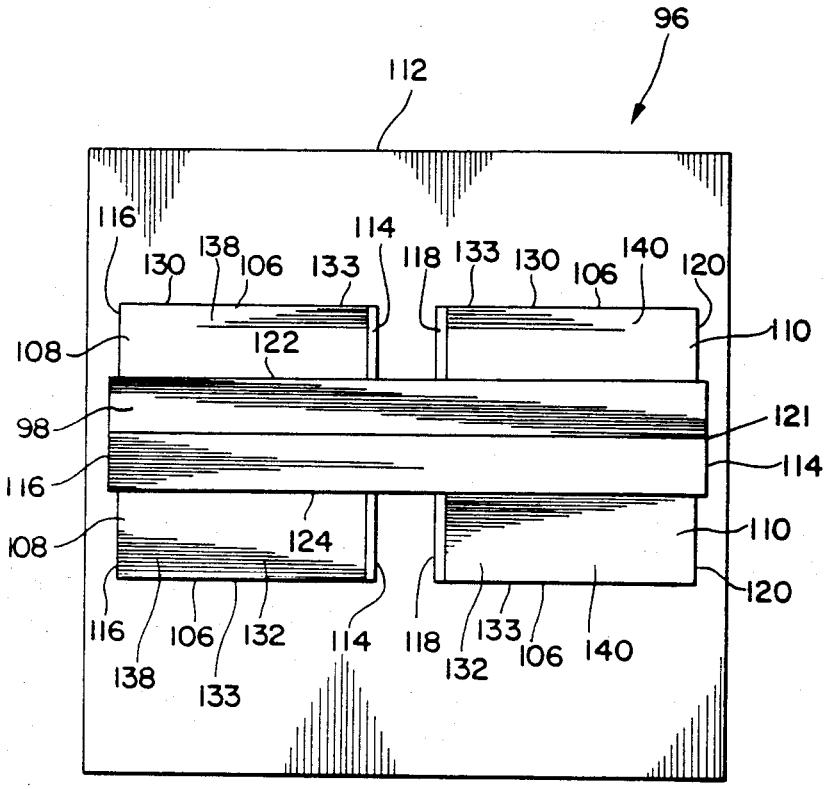
FIG. 16 is an enlarged top plan view of the modified brick fastener shown in FIG. 15.

Another modified fastener 114 is shown in FIGS. 15 and 16. It has a rectangular shank 116 extending in each opposite direction from an integrally formed spacer 118 and terminating at opposite outer ends 120 and 121. The rectangular shank 116 has two relatively broad oppositely positioned side walls 122 and 124, connected at opposite ends by relatively short end wall 126 at one end, relatively short end wall 128 at the opposite end.

A plurality of spaced apart ribs 130 extend outwardly from side wall 122 of the shank 116 and a plurality of spaced apart ribs 132 extend outwardly from the opposite side wall 124 of the shank 116. The combined laterial dimension of the cross-sectional dimension of shank 116 between side walls 122 and 124, the outwardly extending dimension of ribs 130 from side wall 122, and the outwardly extending dimension of ribs 132 from side wall 124, is in total slightly greater than the corresponding lateral dimension of the rectangular recesses 80 and 82 between their respective side walls 92 and 94. The ribs 130 and 132 therefore have to flex in a direction opposite from the direction of insertion when the modified fastener 114 is inserted into the rectangular recesses 80 and 82. The ribs 130 and 132 therefore are flexed into a position wherein their inner edges 131 form an acute angle with their respective side walls 122 and 124 of the shank 116 facing in the direction away from insertion and toward the direction of withdrawal, if withdrawal were possible. The outer edges 133 of ribs 130 and 132 when inserted and flexed form an obtuse angle with the respective side walls 92 and 94 of rectangular recesses 80 and 82 facing in the same direction away from the direction of insertion and toward the direction of withdrawal.

Thus the ribs 130 and 132 in such flexed position when inserted into the recesses 80 and 82 provide a "fish-hook" effect to prevent withdrawal of the fasteners 114 from the recesses 80 and 82 and to thereby also prevent pulling apart of the bricks in whose apertures 80 and 82 each of the opposite ends of the fasteners 114 have been received.

In the modified fastener 114, the ribs 130 and 132 include a first spaced apart column of ribs 134 projecting outwardly from the shank 116 on one side of spacer 118, which extend inwardly of shank 116 from its end wall 126 at a diagonal in the direction toward its opposite end wall 128 as well as toward outer end 120 and terminating short of the mid-line of the respective side walls 122 and 124; and a second spaced apart column of ribs 136 projecting outwardly from the shank 116 on the same side of spacer 118, which extend inwardly of shank 116 from its end wall 128 at a diagonal in the direction toward opposite end wall 126 as well as toward outer end 120 and terminating short of the mid-line of the respective side walls 122 and 124.

The ribs 130 and 132 on opposite side walls 122 and 124 also include a third spaced apart column of ribs 138 which project outwardly from the shank 116 on the opposite side of spacer 118, and which extend inwardly of shank 116 from its end wall 126 at a diagonal in the direction toward its opposite end wall 128 as well as toward outer end 121 and terminating short of the mid-line of the respective side walls 122 and 124; and a fourth spaced apart column of ribs 140 projecting outwardly from the shank 116 on the same side of spacer 118, which extend inwardly of shank 116 from its end wall 128 at a diagonal in the direction toward opposite end wall 126 as well as toward outer end 121 and terminating short of the mid-line of the respective side walls 122 and 124.

Thus in the modified fastener 114, the outer edges 133 of the ribs 130 and 132 engage the long side walls 92 and 94 of brick recesses 80 and 82 along a diagonal line which when extended outwardly to intersect the nearest adjacent short side wall 88 and 90 of the recesses 80 and 82, intersect such nearest adjacent short side wall at an acute angle facing in the direction of withdrawal and away from the direction of insertion. Such construction which positions the outer edges 133 of ribs 130 and 132 along such diagonal line in flexed and gripping contact with the long side walls 92 and 94 respectively of brick recesses 80 and 82, as well as at an obtuse angle thereto as a result of being flexed when inserted to provide a "fish-hook" effect against withdrawal, serves to distribute the effect of any attempted withdrawal forces on the internal structure of the brick over a laterally extending area in the direction outwardly toward and beyond each short side wall 88 and 90 of recesses 80 and 82, as well as over the longitudinally extending area immediately in line with the ribs 130 and 132 in the direction of withdrawal. In other words, the withdrawal forces fan out from the diagonal lines where by the ribs 130 and 132 engage and grip agains the respective long side walls 92 and 94 of the rectangular recesses 80 and 82, and are thus more widely distributed throughout the internal structure of the brick. This construction increases the ability of structure of the brick to withstand withdrawal forces before it begins to break apart, thus increasing the tensile strength of brick walls in which modified fasteners 114 are used to couple adjacent bricks together in closely spaced apart relationship.

Figure 17:
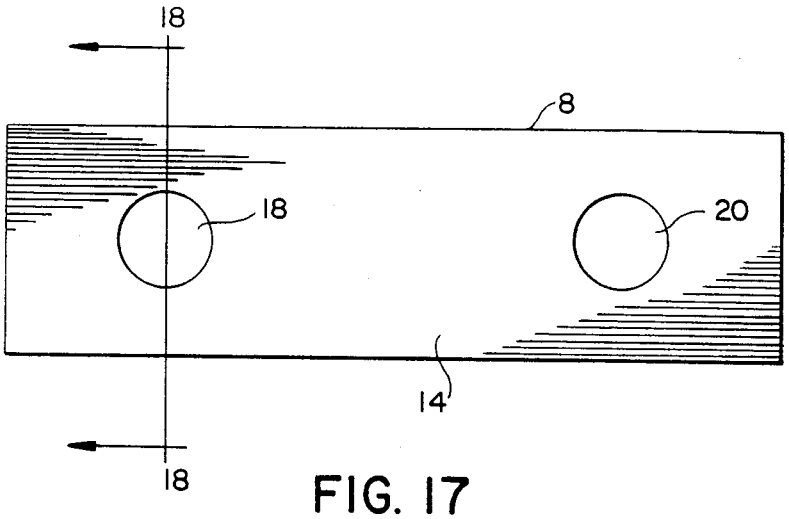
FIG. 17 is a plan view of a brick in accordance with this invention having circular recesses which extend all the way through the brick and are formed by an extrusion process.
Figure 18:
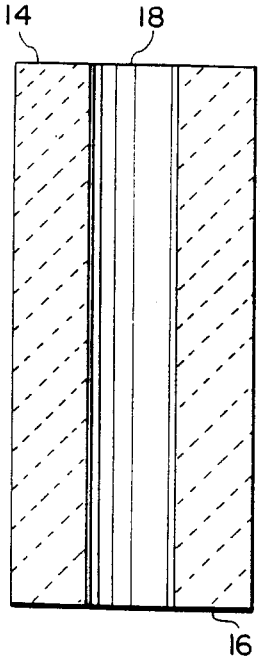
FIG. 18 is a section view taken on line 18—18 of FIG. 17 showing one of the recesses extending all the way through the brick and opening to both the top and bottom walls of the brick.

The recesses 18 and 20 shown in FIG. 17 are offset from the center of the respective halves of the brick in which each is located, and offset in the direction away from the center of the brick, so that when the left half of a brick as shown in FIG. 17 is placed above the right half of a second such brick and their respective offset recesses are axially aligned, and above the left half of a third such brick and their respective offset recesses are axially aligned, there will be a space between the second and third bricks. The distance such recesses are offset from the centers of their respective halves of the brick in the direction away from the center of the brick is that which will space the second brick from the third brick the desired distance for a layer of mortar to be placed therebetween.

I claim:

1. A brick wall of reduced thickness having tensile strength, comprising a plurality of bricks placed one above the other, including a first brick, a second brick in place above said first brick, and holding means to hold said first brick from movement downwardly away from said second brick and said second brick from movement upwardly away from said first brick, wherein said first brick includes a top wall facing upwardly, said second brick includes a bottom wall facing downwardly in facing relationship with at least a portion of said top wall of said first brick, a first recess in said first brick opening to said top wall thereof, a second recess in said second brick opening to said bottom wall thereof, said first and second recesses being axially aligned, said holding means including said first and second recesses, a coupling member having a first projecting element for insertion into said first recess and a second projecting element for insertion into said second recess, said first and second projecting elements having retention means to retain said projecting elements in said recesses when received therein, said first and second bricks having spaced apart side walls extending normal to said top wall of said first brick and said bottom wall of said second brick, said side walls being spaced apart a preselected relatively short distance to provide a reduced thickness brick, said preselected distance said side walls of said bricks are spaced apart is preselected to provide room for a single recess centered therebetween having a preselected cross-sectional dimension in the direction said side walls are spaced apart, such preselected cross-sectional dimension of said recess being substantially about one-half of the distance between the respective edges of said recess nearest respective ones of said spaced apart side walls and respective ones of said side walls, said preselected distance said side walls of said bricks are spaced apart being less than three and three-fourths inches such dimension being substantially the thickness between side walls of standard bricks used in making an ordinary brick wall lacking tensile strength.

2. A brick wall of reduced thickness having tensile strength as set forth in claim 1, wherein said first brick includes a top wall facing upwardly, said second brick includes a bottom wall facing downwardly in facing relationship with at least a portion of said top wall of said first brick, a first recess in said first brick opening to said top wall thereof, a second recess in said second brick opening to said bottom wall thereof, said first and second recesses being axially aligned, said holding means including said first and second recesses, a coupling member having a first projecting element for insertion into said first recess and a second projecting element for insertion into said second recess, said first and second projecting elements having retention means to retain said projecting elements in said recesses when received therein.

3. A brick wall of reduced thickness having tensile strength as set forth in claim 2, wherein said first brick includes a bottom wall spaced apart oppositely from said top wall thereof, said second brick includes a top wall spaced apart oppositely from said bottom wall thereof, said first recess opening to said top wall of said first brick extending through said first brick and also opening to the said bottom wall thereof, said second recess opening to said bottom wall of said second brick extending through said second brick and also opening to the said top wall thereof.

4. A brick wall of reduced thickness having tensile strength as set forth in claim 2, wherein said retention means of said first and second projecting elements of said coupling member include a plurality of laterally extending ribs projecting outwardly from said projecting elements, spaced apart from each other longitudinally along said projecting elements, said laterally extending ribs being slightly flexible under pressure and projecting outwardly from said projecting elements a sufficient distance to contact a side wall portion of said recesses when inserted therein and flex in the direction opposite from the direction of insertion while being inserted therein, said laterally extending ribs when inserted in said recesses forming an acute angle with their said projecting elements facing in the direction of withdrawal, the outer ends of said laterally extending ribs at such time forming an obtuse angle with said side wall portions of said recesses facing in the same said direction of withdrawal, whereby said outer ends of said laterally extending ribs tend to dig into said side wall portions of said recesses when force is applied to said projecting elements in the direction of withdrawal and said ribs attempt to return from their flexed position to their original unflexed position causing them to attempt to also extend outwardly and thereby tend to dig more securely into said side wall portions of said recesses and thereby hold said projecting elements against withdrawal from said recesses.

5. A brick wall of reduced thickness having tensile strength as set forth in claim 4, wherein said recesses in said bricks are cylindrical, said projecting elements include an elongated shank, and said laterally extending ribs project from said elongated shank toward the right thereof, toward the left thereof, toward the front thereof and toward the rear thereof.

6. A brick wall of reduced thickness having tensile strength as set forth in claim 4, wherein said recesses in said bricks are cylindrical, said projecting elements include an elongated shank, said laterally extending ribs project from said elongated shank, each of said laterally extending ribs comprising a continuous annular ring which extends entirely around said elongated shank.

7. A brick wall of reduced thickness having tensile strength as set forth in claim 4, wherein said coupling member includes an integrally formed spacing member between said first and second projecting elements, said spacer member having a thickness dimension corresponding to the desired thickness of mortar to be subsequently placed between said first and second bricks and a cross-sectional dimension greater than the cross-sectional dimension of said recesses.

8. A brick wall of reduced thickness having tensile strength as set forth in claim 2, wherein said first and second recesses are rectangular in cross-section having a pair of spaced apart long side walls joined at each opposite end by respective ones of a pair of short end walls, said projecting elements of sad coupling member comprising elongated rectangular members having a pair of opposite long side walls joined at each opposite end by respective ones of a pair of short end walls, said retention means comprising a plurality of laterally extending ribs projecting outwardly from each of said opposite long side walls of said elongated rectangular members a distance sufficient to contact and flex said laterally extending ribs in the direction opposite from that of insertion when said projecting elements are inserted in said recesses, said ribs extending parallel to said top wall of said first brick and to said bottom wall of said second brick positioned thereabove.

9. A brick wall of reduced thickness having tensile strength as set forth in claim 8, wherein said long side walls and said ribs of said elongated rectangular members are shorter than said long side walls of said recesses, whereby said coupling member can be slidingly moved under pressure while its said first and second projecting elements are received in said first and second recesses respectively of said first and second bricks to thereby adjust the relative horizontal position of said first brick below relative to said second brick above.

10. A brick wall of reduced thickness having tensile strength as set forth in claim 8, wherein said coupling member includes an integrally formed spacing member between said first and second projecting elements, said spacing member having a thickness dimension corresponding to the desired thickness of mortar to be subsequently placed between said first and second bricks and a cross-sectional dimension greater than the distance between said spaced apart long side walls of said rectangular recesses.

11. A brick wall of reduced thickness having tensile strength as set forth in claim 1, including vertical spacing means to space said first brick apart from said second brick vertically a preselected vertical distance while being held from movement upwardly and downwardly away from each other.

12. A brick wall of reduced thickness having tensile strength as set forth in claim 11, wherein said vertical spacing means includes a spacing member having an upper end wall, a lower end wall and a vertically extending peripheral wall with a vertical dimension corresponding to that of a desired thickness of mortar to be subsequently placed between said first and second bricks, said spacer member being positioned between said first and second bricks with its said lower end wall in contact with said top wall of said first brick and its said upper end wall in contact with said bottom wall of said second brick.

13. A brick wall of reduced thickness having tensile strength as set forth in claim 1, wherein said brick wall includes a third brick in place alongside said first brick, said first brick including a first end wall, said third brick including a first end wall facing said first end wall of said first brick and spaced apart therefrom horizontally a preselected horizontal distance, including horizontal spacing means to space said first brick apart from said third brick horizontally said preselected horizontal distance and to hold said first and third bricks from horizontal movement toward and away from each other.

14. A brick wall of reduced thickness having tensile strength as set forth in claim 13, wherein said first brick includes a top wall, a left horizontal half and a right horizontal half, said second brick includes a bottom wall, a left horizontal half and a right horizontal half, said third brick includes a top wall, a left horizontal half and a right horizontal half, a first recess in said first brick opening to said top wall of said right horizontal half thereof, a second recess in said second brick opening to said bottom wall of said left horizontal half thereof, a third recess in said second brick opening to said bottom wall of said right horizontal half thereof, a fourth recess in said third brick opening to said top wall of said left horizontal half thereof, said first and second recesses being axially aligned, said third and fourth recesses being axially aligned, a first coupling member having a first projecting portion for insertion into said first recess located in said right half of said first brick, and a second projecting portion for insertion into said second recess located in said left half of said second brick, a second coupling member having a first projecting portion for insertion into said fourth recess located in said left half of said third brick and a second projecting portion for insertion into said third recess located in said right half of said second brick, said recesses being offset from the center of their respective halves of the bricks in which they are located a preselected offset distance in the direction away from the center of respective bricks, such preselected offset distance being that which will space said first brick and said third brick apart horizontally said preselected horizontal distance when said first and second coupling members are received in said first and second recesses and said third and fourth recesses respectively, said preselected horizontal distance which said first and third bricks are spaced apart corresponding to the desired thickness of mortar to be placed between said first and third bricks, said first, second, third and fourth recesses and said first, and second coupling members comprising said horizontal spacing means.

15. A brick wall of reduced thickness having tensile strength as set forth in claim 14, wherein all of the said plurality of bricks in said brick wall have substantially the same shape and dimensions, all have a right horizontal half and a left horizontal half, all have a top wall and a bottom wall, all have a recess extending through their respective said right horizontal halves opening to both the said top and bottom walls thereof and a recess extending through their respective said left horizontal halves opening to both said top and bottom walls thereof, each of said recesses being offset from the center of their respective halves said preselected offset distance, said recess in the right horizontal half of each brick below being axially aligned with said recess in the left horizontal half of each brick above, said recess in the left horizontal half of each brick below being axially aligned with said recess in the right horizontal half of each brick above, and a plurality of said coupling members received in each set of said axially aligned recesses.

16. A brick wall of reduced thickness having tensile strength as set forth in claim 8, wherein all of said recesses in all of said bricks are cylindrical.

17. A brick wall of reduced thickness having tensile strength as set forth in claim 1, wherein said preselected distance said side walls of said bricks are spaced apart is no greater than substantially one-half of three and three-fourths inches, such dimension of three and three-fourths inches being substantially that which the side walls of standard bricks used in making an ordinary brick wall lacking tensile strength are spaced apart.

18. A brick wall of reduced thickness having tensile strength as set forth in claim 17, wherein the said preselected cross-sectional dimension of said single recess is substantially three-eighths of an inch, said single recess having a first edge nearest a first side wall of a one of said bricks, including said first side wall of a one of said bricks, and a second edge nearest a second and opposite side wall of said one of said bricks, including said second side wall of said one of said bricks, the distance between said first edge of said recess and said first side wall being substantially twice as great as the dimension of said pre-selected cross-sectional dimension of said single recess or substantially three-fourths of an inch, the distance between said second edge of said recess and said second side wall being substantially twice as great as the dimension of said pre-selected cross-sectional dimension of said single recess or substantially three-fourths of an inch, such total cross-sectional dimensions adding up to a total of substantially one-half of three and three-fourths inches, such total of one half of three and three-fourths inches being substantially said preselected distance said side walls of said bricks making up said brick wall of reduced thickness are spaced apart.

19. A brick wall of reduced thickness having tensile strength as set forth in claim 18, wherein said first and second bricks each include a pair of spaced apart end walls, a first one of said single recesses centered between said spaced apart side walls and having said preselected cross-sectional dimension being located closer to a first one of said pair of said pair of end walls of each of said first and second bricks, and including a second one of said single recesses centered between said spaced apart side walls and having said preselected cross-sectional dimension being located closer to a second and opposite one of said pair of end walls of each of said first and second bricks.

20. A brick wall of reduced thickness having tensile strength as set forth in claim 19, wherein said first brick includes a bottom wall spaced apart from its said top wall, said second brick includes a top wall spaced apart from its said bottom wall, said recesses extend through said bricks and open to both the said top and bottom walls of each of said first and second bricks.

21. A brick wall of reduced thickness having tensile strength as set forth in claim 19, wherein each of said bricks includes only said first and second ones of said single recesses centered between said spaced apart side walls said entire remaining space of said bricks between said side walls and said end walls comprising solid brick material to provide structural integrity and cohesive strength for each of said bricks.

22. A coupling member for use in coupling adjacent bricks together to provide a brick wall having tensile strength, comprising an elongated shank having a first elongated portion terminating in a first end and a second elongated portion terminating at an opposite second end, a first plurality of laterally extending ribs projecting outwardly from around said first elongated portion in spaced apart relationship and capable of being flexed under pressure in the direction away from said first end, a second plurality of laterally extending ribs projecting outwardly from around said second elongated portion in spaced apart relationship and capable of being flexed under pressure in the direction away from said second end, wherein said first and second elongated portions of said elongated shank are rectangular and include a pair of opposite long side walls joined at each opposite end by respective ones of first and second short end walls, said laterally extending ribs projecting outwardly from each one of said opposite long side walls, wherein said laterally extending ribs projecting from each of said opposite long side walls of said first elongated portion comprise a first column of diagonally positioned spaced apart ribs extending inwardly of said first elongated portion from the junction of said opposite long side walls with said first short end wall in a diagonal direction toward said first end and toward said second short end wall, said ribs in said first column terminating at a point between said first short end wall of said first elongated portion and midway thereacross, a second column of diagonally positioned spaced apart ribs extending inwardly of said first elongated portion from the junction of said opposite long side walls with said second short end wall in a diagonal direction toward said first end and toward said first short end wall, said ribs in said second column terminating at a point between said second short end wall of said first elongated portion and midway thereacross, and wherein said laterally extending ribs projecting from each of said opposite long side walls of said second elongated portion comprises a third column of diagonally positioned spaced apart ribs extending inwardly of said second elongated portion from the junction of said opposite long side walls with said first short end wall in a diagonal direction toward said second end and toward said second short end wall, said ribs in said third column terminating at a point between said first short end wall of said second elongated portion and midway thereacross, and a fourth column of diagonally positioned spaced apart ribs extending inwardly of said second elongated portion from the junction of said opposite long side walls with said second short end wall in a diagonal direction toward said second end and toward said first short end wall, said ribs in said fourth column terminating at a point between said second short end wall of said second elongated portion and midway thereacross.

* * * * *